United States Patent [19]

Bice et al.

[11] 4,203,640

[45] May 20, 1980

[54] ELECTRICAL CABLE COUPLER WITH ROTATABLE PROTECTIVE COVERS

[75] Inventors: Charles D. Bice, Pittsburgh; John H. Cooper, Murrysville; Michael L. Fenger, Westmoreland City, all of Pa.

[73] Assignee: The United States of America as represented by the Secretary of the Interior, Washington, D.C.

[21] Appl. No.: 6,138

[22] Filed: Jan. 24, 1979

[51] Int. Cl.[2] ..... H01R 13/44

[52] U.S. Cl. ..... 339/41; 339/42

[58] Field of Search ..... 339/41, 42

[56] References Cited

U.S. PATENT DOCUMENTS 3,281,752 10/1966 Newman ..... 339/41

FOREIGN PATENT DOCUMENTS 533338 11/1954 Belgium ..... 339/41

839519 5/1952 Fed. Rep. of Germany ..... 339/41

*Primary Examiner*—Joseph H. McGlynn

*Attorney, Agent, or Firm*—Thomas Zack; Donald A. Gardiner

[57] ABSTRACT

An improved electrical cable coupler incorporates rotatable protective covers on its plug and socket members to automatically protect the plug and socket contacts against contamination when the plug and socket members are disconnected and to allow the contacts to be electrically engaged when the plug and socket members are connected together. Each protective cover includes one or more openings which correspond in number and location to the electrical contacts on the plug and socket members. Each cover is rotatable between a protective position in which its openings are out of alignment with the respective contacts to provide protection against contamination and an operative position in which the openings are aligned with the respective contacts to expose the contacts for electrical engagement. The protective covers are adapted to interlock when moved into face-to-face engagement so that, by twisting the plug and socket members in opposite directions, the cover openings are moved into registration with the contact elements to allow electrical engagement therebetween. At least one of the protective covers is slidably mounted to permit relative axial movement of the plug and socket members to bring the contacts into electrical engagement.

16 Claims, 9 Drawing Figures

Fig. 1
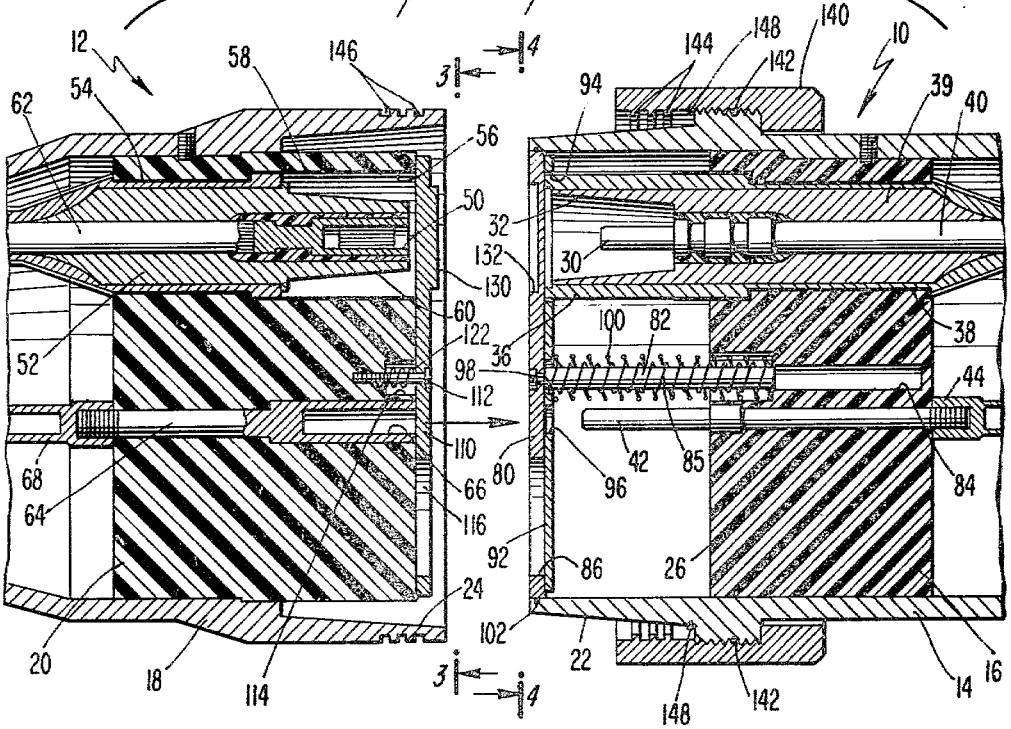
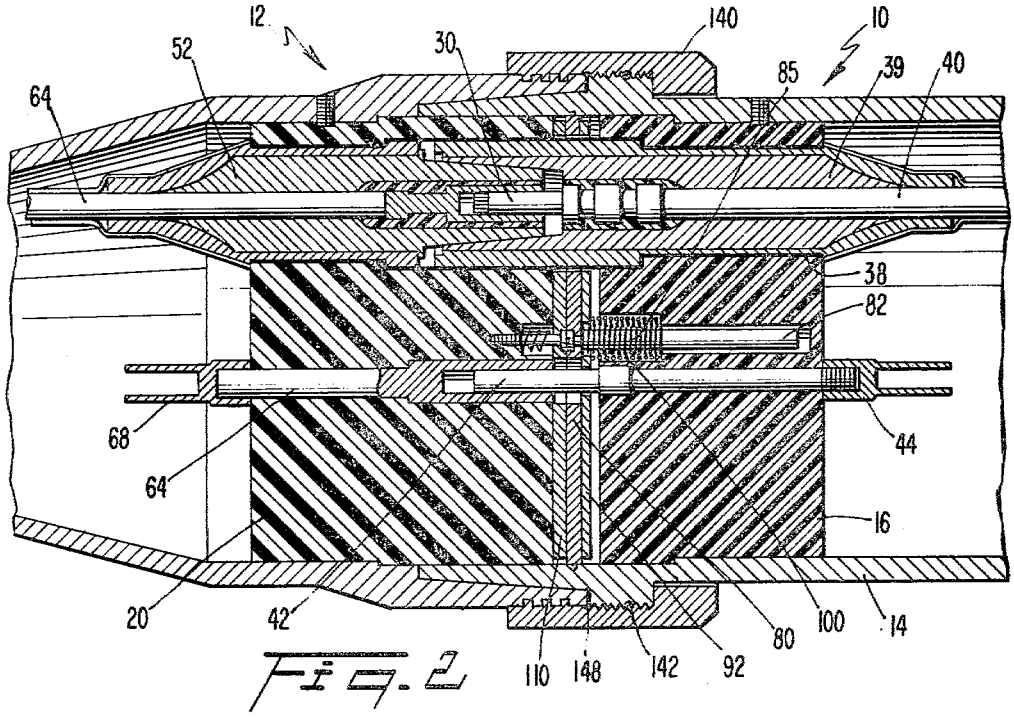
Fig. 2

120
130
70
50
136
12
116
116
112
110
94
138
50
14
102
50
18
64
118
116

50
94
14
36
39
32
86
32
116
130
132
20
132
30
90
46
86
30
39
92
50
112
36
20
80
42
60
80
110
110
86
30
30
10
88
86

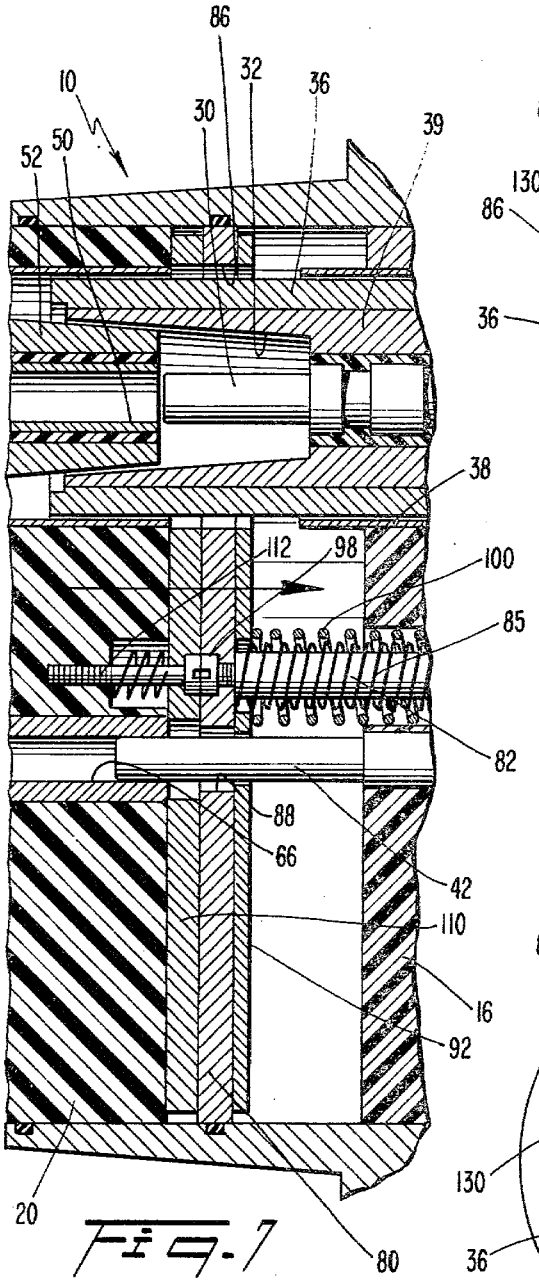
Fig. 7
Fig. 8
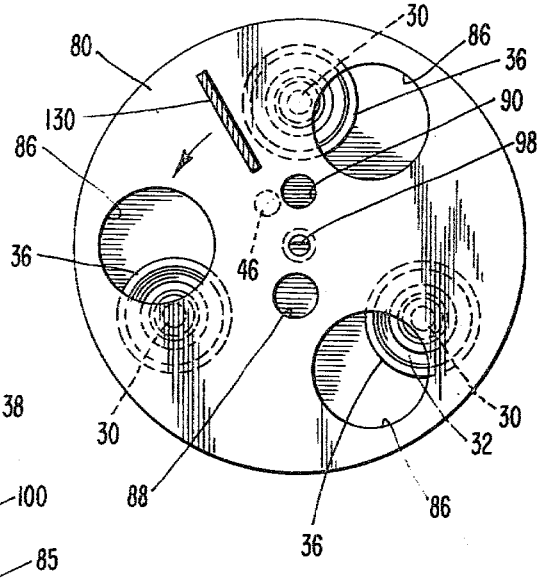
Fig. 9
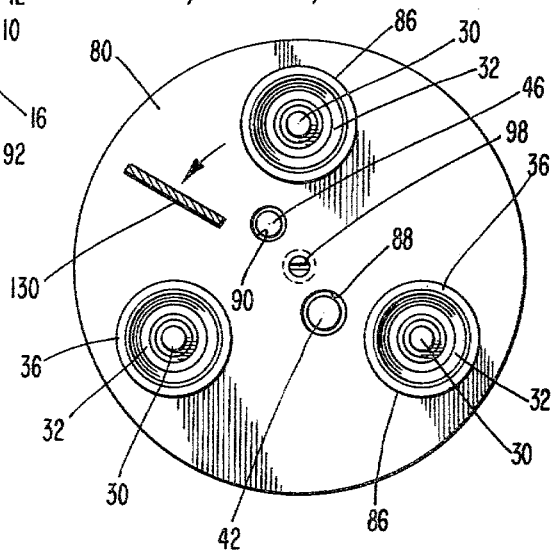

ELECTRICAL CABLE COUPLER WITH ROTATABLE PROTECTIVE COVERS

TECHNICAL FIELD

The present invention relates to an electrical cable coupler provided with a protective cover arrangement to protect the coupler contacts against contamination by dust and moisture and, more particularly, to an improved electrical cable coupler wherein plug and socket members are each provided with a rotatable protective cover which normally covers its electrical contacts when the plug and socket are uncoupled and which rotates to expose the contacts for electrical engagement when the plug and socket members are coupled together.

BACKGROUND ART

In the field of electrical cable couplers, it is necessary to protect the electrical contacts and insulation of the coupler sections against contamination by dust and moisture. The need for protection is especially critical when the coupler sections are disconnected in environments, e.g., coal mines, which contain an abundant supply of contaminants.

Typically, to provide the desired protection against dust and moisture, prior art cable couplers have included screw-on end caps which are chained to the housings of the coupler sections. Under typical operating conditions, the chains connecting the end caps to the coupler sections eventually become broken and the end caps are lost or misplaced. Since the screw-on end caps must be manually attached to the coupler sections, there has been a tendency for users to ignore the requirement of replacing the end caps when the coupler sections are disconnected so that the electrical contacts and insulation are unprotected even though the end caps are not lost or misplaced. As a result, the use of screw-on end caps has not provided a completely satisfactory protective cover arrangement for electrical cable couplers.

To overcome the disadvantages of manual screw-on end caps, it has been proposed to provide automatic protective cover arrangements which automatically operate when the coupler sections are disconnected to provide the desired protection against dust and moisture. Typically, the automatic arrangements have provided protective covers for the socket or female section of the cable coupler, but no protective cover has been provied for the plug or male section of the cable coupler. As a result, the electrical contacts and insulation of the plug or male section of the cable coupler have generally been unprotected against contamination by dust and moisture. See, for example, U.S. Pat. No. 3,525,068 disclosing an electrical connector wherein a tumbler member is rotatably mounted within the socket body for movement from an initial position covering the electrical contacts provided therein to a second position placing the plug contacts into electrical engagement with the socket contacts, and U.S. Pat. No. 3,982,804 disclosing an electrical connection device wherein the socket is provided with a rotatable safety disc which normally covers the socket contacts when the plug is disconnected and which rotates when the plug is engaged with the cover to allow the plug contacts to be inserted into the socket contacts.

Accordingly, it is a primary object of the present invention to provide an improved electrical cable coupler which incorporates an automatically operable protective cover arrangement on both of its coupler sections to protect its electrical contacts and insulation from contamination.

Another object of the invention is to provide an electrical cable coupler wherein plug and socket members are each provided with rotatable protective covers which normally cover the respective electrical contacts to provide protection against contamination when the plug and socket members are disconnected.

It is also an object of the invention to provide an electrical cable coupler comprising plug and socket members provided with rotatable protective covers which are adapted to interlock and rotate as a unit when the covers are placed in face-to-face engagement and the plug and socket members are twisted in opposite directions to allow the plug and socket contacts to be electrically engaged.

A further object of the invention is to provide an electrical cable coupler comprising plug and socket members provided with rotatable protective covers wherein at least one of the covers is inwardly slidable to allow the plug and socket contacts to be electrically engaged by axial movement of the plug and socket members together.

It is a further object of the invention to provide an electrical cable coupler comprising plug and socket members provided with rotatable protective covers which are normally biased into protective positions to prevent contamination of the electrical contacts and insulation when the plug and socket members are uncoupled.

DISCLOSURE OF INVENTION

The present invention provides an improved electrical cable coupler which incorporates a rotatable protective cover on each coupler section to protect the electrical contacts and insulation against contamination when the coupler sections are disconnected and to allow the contacts to be electrically engaged when the coupler sections are connected together. Each protective cover includes one or more openings which correspond in number and location to the electrical contacts on its coupler section. Each disc is rotatable between a protective position in which its openings are out of alignment with the respective contacts to provide protection against contamination and an operative position in which the openings are in registration with the respective contacts to expose the contacts for electrical engagement. The protective covers are advantageously adapted to interlock when moved into face-to-face engagement so that, by twisting of the coupler sections in opposite directions, the cover openings are moved into registration with the contact elements to allow electrical engagement therebetween. At least one of the protective covers is slidably mounted on its coupler section to permit relative axial movement between the coupler sections to bring the contacts into electrical engagement.

In accordance with the invention, the electrical cable coupler comprises a first coupler section including one or more electrical contact elements, a second coupler section including one or more electrical contacts adapted for engagement with the contact elements of the first coupler section, a protective cover rotatably mounted on each coupler section for movement between a protective position wherein the respective contact elements are covered to an operative position wherein the contact elements are exposed, and means for nonrotatably coupling the covers together upon movement of the covers into face-to-face engagement whereby upon a relative rotation of the coupler sections each cover rotates to its operative position to expose the contact elements of each coupler section for electrical engagement.

Preferably, each protective cover includes one or more openings suitably located for registration with the respective contact elements when the cover is rotated to its operative position. At least one of the protective covers is slidably mounted on its coupler section to permit axial movement of the coupler sections together to move the contact elements into electrical engagement upon rotation of each cover to its operative position. In addition, each coupler section includes means for normally biasing its protective cover toward the protective position to cover the respective electrical contact elements thereon. Stop means may be provided on one of the coupler sections for limiting the rotation of its cover to define the protective and operative positions of the cover.

A preferred embodiment of the electrical cable coupler comprises a plug member including one or more male electrical contact elements and a socket member including one or more female electrical receptacles for receiving the male contact elements. A first protective cover is rotatably mounted on the plug member and provided with one or more openings therein for registration with the male contact elements. A second protective cover is rotatably mounted on the socket member and provided with one or more openings therein for registration with the female receptacles with the plug and socket members uncoupled. Both covers are normally biased to protective positions with the openings therein out of registration with the male contact elements and female receptacles, respectively, to protect the electrical contact elements and receptacles against contamination. Coupling means is provided for nonrotatably coupling the covers together upon movement of the covers into face-to-face engagement so that, upon twisting of the plug and socket members in opposite directions, the covers rotate into the operative positions to move the respective openings into registration with the male contact elements and female receptacles to permit electrical engagement therebetween.

Preferably, the plug member includes a recessed face from which the male contact elements project and its protective cover is slidably mounted for movement toward and away from the recessed face in its operative position to permit the male contact elements to be received in the female receptacles upon axial movement of the plug and socket members together. An inner, nonrotatable cover is mounted adjacent to the first protective cover for slidable movement toward and away from the recessed face of the plug member. The inner cover includes one or more openings therein aligned with the male contact elements to permit the male contact elements to project therethrough when the first protective cover is rotated into its operative position and moved inwardly to a recessed face. This dual cover arrangement provides complete protection against contamination from dust and moisture. Similarly, if desired, the socket member may also be provided with a recessed face and dual protective cover arrangement to provide protection for the female receptacles.

To couple the protective covers together in face-to-face engagement, a key element may be provided on one of the protective covers for engagement with a slot formed in the other protective cover to interlock the covers for simultaneous rotation when the plug and socket members are twisted in opposite directions. Stop means may be provided on the socket member which is engageable with the second protective cover to limit the rotation of the cover relative to the socket member. For example, a pin may be formed on the socket member which is receivable in an arcuate slot formed in the second protective cover. With the pin in engagement with one end of the slot, the cover is located in the protective position with its openings out of registration with the electrical receptacles, and upon engagement of the pin with the opposite end of the slot, the cover is in its operative position to expose the receptacles for electrical engagement.

BRIEF DESCRIPTION OF DRAWINGS:

The accompanying drawings illustrate a preferred embodiment of the invention and, together with the description, serve to explain the principles and operation of the invention.

FIG. 1 is a vertical section illustrating an electrical cable coupler embodying the invention with its plug and socket members uncoupled;

FIG. 2 is a vertical section of the electrical cable coupler illustrating its plug and socket members coupled together to provide electrical engagement between the plug and socket contacts;

FIG. 7 is an enlarged vertical section illustrating axial movement of the plug and socket members to provide electrical engagement of the contacts; and FIGS. 8 and 9 are front views illustrating the rotational movement of the protective cover on the plug member to expose the plug contacts for electrical engagement.

Figures 3, 4, 5, 6:
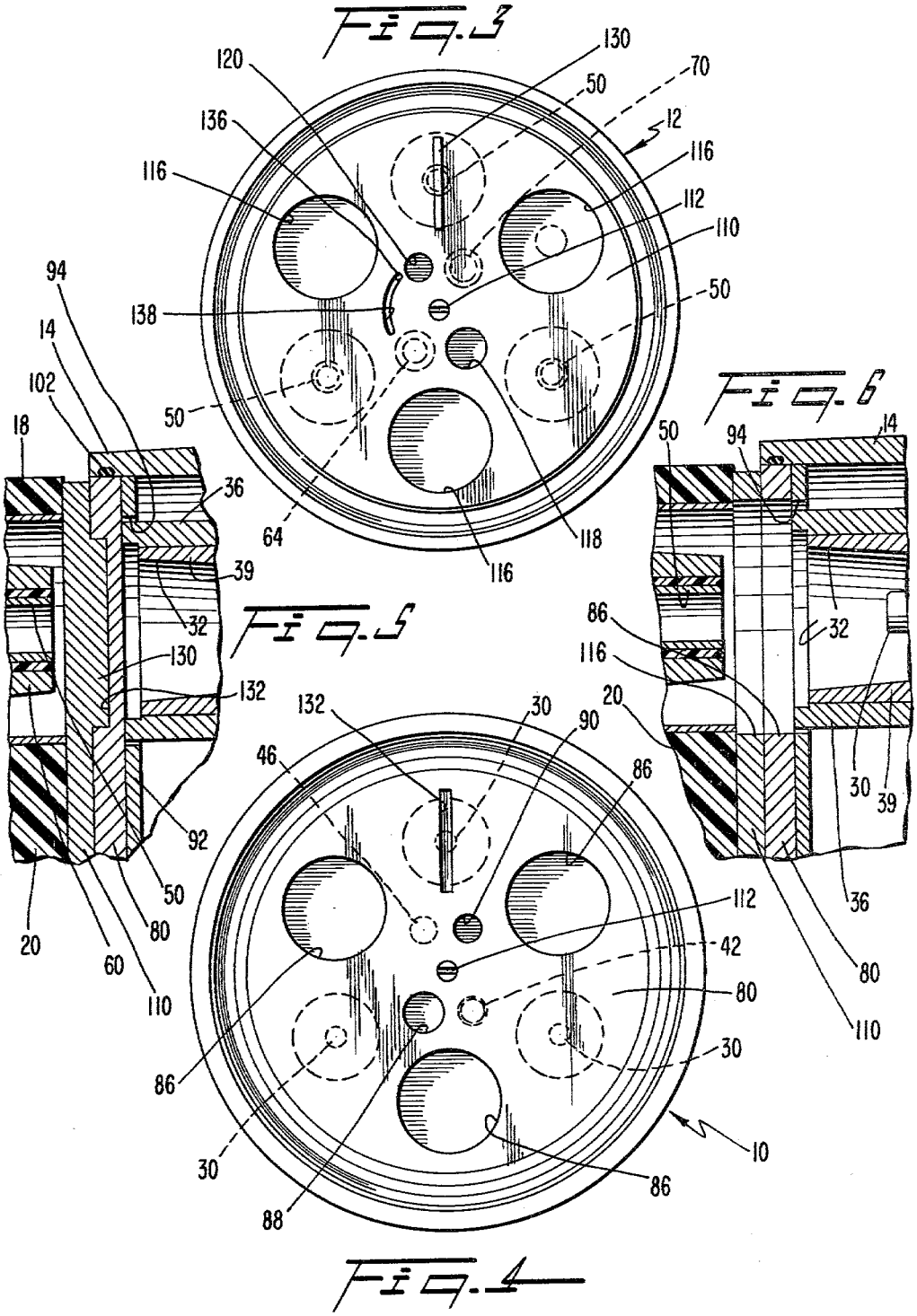
FIG. 3 is a front view of the socket member, taken along line 3—3 of FIG. 1, illustrating the face of a rotatable protective cover provided on the socket member.
FIG. 4 is a front view of the plug member taken along line 4—4 of FIG. 1, illustrating the face of a rotatable protective cover provided on the plug member.
FIG. 5 is an enlarged, fragmentary vertical section illustrating a key and slot arrangement which interlocks the protective covers for simultaneous rotation.
FIG. 6 is an enlarged, fragmentary vertical section illustrating the protective covers rotated to expose the contacts of the plug and socket members for electrical engagement.

DETAILED DESCRIPTION OF PREFERRED EMBODIMENT:

Referring to FIG. 1, an electrical cable coupler suitable for use in coal mining installations comprises a plug member, generally 10, and a socket member, generally 12. Plug member 10 comprises a generally cylindrical housing 14, e.g., metal or plastic, in which a cylindrical insulating spacer 16 is nonrotatably secured. Similarly, socket member 12 comprises a generally cylindrical housing 18, e.g., metal or plastic, in which a cylindrical insulating spacer 20 is nonrotatably secured. The front end of plug housing 14 includes a forwardly tapered peripheral edge 22 which mates with a similarly tapered inner edge 24 of socket housing 18 when the plug and socket members are coupled together. Insulating spacer 16 has a flat front face 26 which is recessed from the front end of plug housing 14.

Plug member 10 includes a plurality of male contact elements 30 equidistantly spaced about front face 26 of insulating spacer 16. Each male contact member 30 is located in a recess or well 32 provided at the front end of an inner metallic sleeve 34 which is surrounded by an outer conductive sleeve 36. The outer sleeve is anchored in an opening extending through insulating spacer 16 and a metallic shield 38 is preferably precast into the opening in the spacer. Male contact element 30 may be soldered into a suitable opening provided in inner sleeve 34 for electrical engagement with a conductor 40 of a polyphase cable. As shown in FIGS. 4 and 9, in a three-phase cable coupler, three male contact elements 30 may be equidistantly spaced at 120° intervals within plug member 10.

As shown in FIG. 1, plug member 10 also includes a rod-like ground contact element 42 projecting from recessed face 26 of insulating spacer 16 which extends through the spacer for connection to a threaded terminal 44 coupled to a ground conductor (not shown). Similarly, a ground test contact 46 (FIGS. 4 and 9), may be provided on insulating spacer 16 at a diametrically opposed position from ground contact element 42.

Socket member 12 includes a plurality of female electrical receptacles 50 for receiving male contact elements 30 of plug member 10. Each female contact element 50 is embedded in the front end of inner metallic sleeve 52 and includes an axial bore for receiving male contact member 30. Inner metallic sleeve 52 is, in turn, received in an outer conductive sleeve 54 located within a suitable opening 56 extending through insulating spacer 20. A precast metallic shield 58 is provided within opening 56 of the insulating spacer. Inner metallic sleeve 52 is provided with a tapered front end 60 which is received in recess 32 when the plug and socket members are coupled together. Female receptacle 50 may be soldered in a suitable opening provided in inner sleeve 52 for electrical engagement with a conductor 62 of a polyphase cable. Preferably, as shown in FIG. 3, in a three-phase cable coupler, three female receptacles 50 are provided in socket member 12 which are equidistantly spaced by 120° intervals to mate with male contact elements 30 of plug member 10.

As shown in FIG. 1, socket member 12 also includes an elongated female ground receptacle 64 embedded in an opening extending through insulating spacer 20 and provided with an axial bore 66 at its front end for receiving rod-like ground contact element 42. The rear end of female ground receptacle 64 is threadably connected to a terminal 68 connected to a ground conductor (not shown). Similarly, as shown in FIG. 3, an additional female ground receptacle 70 may be provided in socket member 12 at a diametrically opposed position from female ground receptacle 64 to mate with male ground test contact member 46 when the plug and socket members are coupled together.

Referring to FIGS. 1 and 4, a first protective cover or disc 80 is rotatably mounted at the front face of plug member 10 to provide protection of the male contact elements against contamination. Disc 80 is secured to a rod 82 which is rotatably and slidably received in an elongated axial opening 84 extending into insulating spacer 16 from its recessed front face 26. Disc 80 includes a set of three enlarged circular openings 86 equidistantly spaced by 120° about the disc for registration with the male contact elements when the disc is rotated from a protective position (FIG. 4) to an operative position (FIG. 9). Similarly, disc 80 is provided with a pair of small circular openings 88 and 90 at diametrically opposed positions on its face and arranged for registration with male contact elements 42 and 46, respectively, when the disc is rotated from its protective position to its operative position.

To normally bias protective cover or disc 80 toward its protective position, a torsion spring 85 is anchored to insulating spacer 16 and secured to rotatable disc 80. The torsion spring serves to normally bias disc 80 to its protective position (FIG. 4) with enlarged openings 86 out of registration with phase contact elements 30 and small openings 88 and 90 out of registration with ground contacts 42 and 46 so that the phase and ground contacts are covered and protected against contamination.

Preferably, plug member 10 includes an inner, nonrotatable cover or disc 92 mounted immediately adjacent to protective cover 80. Inner disc 92 includes a set of three equidistantly spaced enlarged circular openings 94 (one shown in FIG. 1) to slidably mount the disc on sleeves 36 for slidable movement toward and away from recessed face 26 of insulating spacer 16. A pair of small circular openings 96 (one shown in FIG. 1) is provided in disc 92 in alignment with male contact elements 42 and 46 to permit the male contact elements to project through the disc when protective disc 80 is rotated to its operative position and moved inwardly toward recessed face 26 of the insulating spacer. In addition, a central opening 98 is provided in inner disc 92 to allow rod 82 and spring 85 to extend therethrough from rotatable protective disc 80 to insulating spacer 16.

Rotatable protective cover 80 and inner slidable cover 92 are normally biased outward by a compression spring 100 interposed between the inner disc and insulating spacer 16. Compression spring 100 also serves to maintain inner disc 92 firmly engaged with rotatable protective disc 80. Thus, with protective disc 80 biased to its protective position by torsion spring 85, openings 86 in the rotatable disc are completely covered by inner disc 92 to preclude entry of dust or moisture. An O-ring seal 102 provided at the front, inner edge of plug housing 14 engages the periphery of protective disc 80 to further block the entry of dust or moisture into the plug member.

Socket member 12 includes a second protective cover or disc 110 rotatably mounted at its front end by a central pivot pin 112 secured to insulating spacer 20 within a recessed opening 114. Protective disc 110 includes a set of three enlarged circular openings 116 equidistantly spaced by 120° for registration with female electrical receptacles 50 when the disc is rotated from its protective position to its operative position. Similarly, disc 110 includes a pair of small circular openings 118 and 120 for registration with female receptacles 64 and 70, respectively, when the disc is rotated to its operative position. A torsion spring 122 located within central recess 114 is anchored to insulatingspacer 20 and secured to protective disc 110 to normally bias the disc to its protective position where the female contacts are covered and protected against contamination by dust or moisture. Alternatively, a spiral spring (not shown) may be used in place of torsion spring 122. Protective disc 110 is slidably engaged with the front face of insulating spacer 20 so that recesses 56 are tightly sealed with the disc in its protective position. In addition, if desired, the front face of insulating spacer 20 may be recessed and protective cover 110 may be slidably mounted with an inner, nonrotatable disc (not shown) to provide a rotatable and slidable protective cover assembly on the socket member.

The electrical cable coupler includes means for nonrotatably coupling the protective covers together upon movement of the covers in face-to-face engagement. For example, protective cover 110 of socket member 12 is provided with a key element 130 projecting forwardly from its front face for engagement with a slot 132 formed in the face of protective cover 80 of plug member 10. Upon movement of protective covers 80 and 110 into face-to-face engagement (FIG. 5), key element 130 fits into slot 132 to interlock the covers for simultaneous rotation. Thereafter, upon relative rotation of the plug and socket members, the covers rotate relative to the plug and socket members into the operative positions (FIG. 6) to permit electrical engagement between the male contact elements and female receptacles.

In the preferred embodiment, stop means is provided on socket member 12 for limiting the rotation of its protective cover 110 to define the protective and operative positions of the cover. For example, as shown in FIG. 3, a pin 136 formed on insulating spacer 20 is received in an arcuate slot 138 formed in protective cover 110. Torsion spring 122 (FIG. 1) normally biases disc 110 into a protective position with pin 136 (FIG. 3) in engagement with the upper end of slot 138 so that circular openings 116, 118 and 120 are out of registration with the corresponding female receptacles. When disc 110 is rotated in a clockwise direction (as viewed in FIG. 3), pin 136 is moved into engagement with the lower end of slot 138 to define the operative position of the disc with its openings aligned with the corresponding female receptacles.

Referring to FIG. 1, plug member 10 includes a coupling collar 140 threadably secured to plug housing 14. An O-ring seal 142 interposed between threaded sections of coupling collar 140 and plug housing 14 provides a tight seal therebetween. Coupling collar 140 includes a set of internal ribs 144 adapted to be snap fitted into a set of exterior grooves 146 provided adjacent to the front end of socket housing 18. An O-ring seal 148 mounted on plug housing 14 engages the front end of socket housing 18 to provide a tight seal when the plug and socket members are coupled together.

With the plug and socket members uncoupled, protective covers 80 and 110 are normally biased into the protective positions covering the respective male contact elements and female receptacles to prevent contamination by dust or moisture. When it is desired to couple the plug and socket members together, both members are axially aligned to bring protective covers 80 and 110 into face-to-face engagement with key element 130 inserted into slot 132 (FIG. 5) to interlock the covers for simultaneous rotation. Thereafter, the plug and socket members are rotated by twisting the members in opposite directions. The interlocked covers rotate as a single unit relative to socket member 12 until pin 136 contacts the lower end of slot 138 to stop disc 110 in its operative position. As shown in FIGS. 8 and 9, the rotation of plug member 10 relative to socket member 12 is continued until protective disc 80 is located in its operative position relative to male contact elements 30. With both discs in the operative positions (FIG. 6), openings 86 and 116 are in registration with male contact elements 30 and female receptacles 50, respectively, to permit electrical engagement therebetween.

Next, as shown in FIG. 7, the plug and socket members are moved axially together to allow male contact elements 30, 42 and 46 to move through the corresponding openings in protective discs 80 and 110 into engagement with female receptacles 50, 64 and 70, respectively. When the plug and socket members are moved completely together, coupling collar 140 is snap fitted onto socket member 12 to secure the members together.

When the plug and socket members are uncoupled to break electrical contact, covers 80 and 92 of plug member 10 are biased outwardly by compression spring 100 and outer cover 80 is rotated back to its protective position by torsion spring 85. Similarly, protective cover 110 of socket member 12 is rotated back to its protective position by torsion spring 122.

The present invention provides an improved electrical cable coupler which advantageously employs protective covers on its plug and socket members automatically operable when the plug and socket members are uncoupled to protect the plug and socket contacts against contamination. In addition, the protective covers are adapted to be conveniently interlocked and rotated into operative positions where the plug and socket contacts are exposed for electrical engagement.

The invention is not limited to the specific details shown and described, and modifications may be made in the electrical cable coupler without departing from the principles of the invention.

We claim:

1. An electrical cable coupler, comprising:

a first coupler section including one or more electrical contact elements;

a second coupler section including one or more electrical contact elements adapted for engagement with said contact elements of said first coupler section;

a protective cover rotatably mounted on each coupler section for movement between a protective position wherein the respective contact elements are covered to an operative position wherein said contact elements are exposed; and means for nonrotatably coupling said covers together upon movement of said covers into face-to-face engagement whereby upon relative rotation of said coupler sections each cover rotates to its operative position to expose said contact elements of each coupler section for electrical engagement.

2. The electrical cable coupler of claim 1, each coupler section includes:

means for normally biasing its protective cover toward the protective position to cover the respective electrical contact elements thereon.

3. The cable coupler of claim 1, which includes:

stop means provided on one of said coupler sections for limiting the rotation of its protective cover to define the protective and operative positions of said cover.

4. The electrical cable coupler of claim 1, wherein said coupling means comprises:

a key element provided on one of said protective covers for engagement with a slot formed in the other protective cover to interlock said covers for simultaneous rotation.

5. The electrical cable coupler of claim 1, which includes:

means for securing said coupler sections together to maintain said contact elements in electrical engagement.

6. The electrical cable coupler of claim 1, wherein:

each protective cover includes one or more openings therein for registration with the respective contact elements with said cover rotated to its operative position.

7. The electrical cable coupler of claim 6, wherein:

at least one of said protective covers is slidably mounted on its coupler section to permit axial movement of said coupler sections together to move said contact elements into electrical engagement upon rotation of each cover to its operative position.

8. An electrical cable coupler, comprising:

a plug member including one or more male electrical contact elements;

a socket member including one or more female electrical receptacles for receiving said male contact elements;

a first protective cover rotatably mounted on said plug member and provided with one or more openings therein for registration with said male contact elements, said first cover being normally biased to a protective position with its openings out of registration with said male contact elements and rotatable to an operative position with said openings in registration with said male contact elements;

a second protective cover rotatably mounted on said socket member and provided with one or more openings therein for registration with said female receptacles, said second cover being normally biased to a protective position with its openings out of registration with said female receptacles and rotatable to an operative position with said openings in registration with said female contact elements; and coupling means for nonrotatably coupling said covers together upon movement of said covers into face-to-face engagement whereby upon relative rotation of said plug and socket members said covers rotate into the operative positions to move the respective openings into registration with said male contact elements and said female receptacles to permit electrical engagement therebetween.

9. The electrical cable coupler of claim 8, which includes:

first spring means on said plug member for normally biasing said first cover to its protective position; and second spring means on said socket member for normally biasing said second cover to its protective position.

10. The electrical cable coupler of claim 8, wherein said coupling means comprises:

a key element provided on one of said protective covers for engagement with a slot formed in the other protective cover to interlock said covers for simultaneous rotation.

11. The electrical cable coupler of claim 8, which includes:

means for securing said plug and socket members together to maintain said male contact elements and said female receptacles in electrical engagement.

12. The electrical cable coupler of claim 8, wherein:

said plug member includes a recessed face from which said male contact elements project; and said first protective cover is slidably mounted for movement toward and away from said recessed face in its operative position to permit said male contact elements to be received in said female receptacles upon axial movement of said plug and socket members together.

13. The electrical cable coupler of claim 12, which includes:

means for normally biasing said first protective cover outwardly away from said recessed face of said plug member.

14. The electrical cable coupler of claim 12, wherein said plug member includes:

an inner nonrotatable cover mounted adjacent to said protective cover for slidable movement toward and away from said recessed face, said inner cover including one or more openings therein aligned with said male contact elements to permit said male contact elements to project therethrough when said first protective cover is rotated to its operative position and moved inwardly toward said recessed face.

15. The electrical cable coupler of claim 8, which includes:

stop means provided on said socket member and engageable with said second protective cover to limit the rotation of said second protective cover relative to said socket member.

16. The electrical cable coupler of claim 15, wherein said stop means comprises:

a pin formed on said socket member and receivable in an arcuate slot formed in said second protective cover.

* * * * *